United States Patent [19]

Helveston et al.

[11] 4,303,037

[45] Dec. 1, 1981

[54] SINGLE POINT MOORING SYSTEM

[75] Inventors: Wilton L. Helveston; Richard J. Pecoraro, both of New Iberia, La.

[73] Assignee: International Moorings & Marine, Inc., New Iberia, La.

[21] Appl. No.: 15,417

[22] Filed: Feb. 26, 1979

[51] Int. Cl.[3] ..... B63B 21/00

[52] U.S. Cl. ..... 114/230; 114/293; 9/8 R; 405/524

[58] Field of Search ..... 114/293–310, 114/230; 405/224; 9/8 R, 83 R, 83 E

[56] References Cited

U.S. PATENT DOCUMENTS 2,903,716 9/1959 Zasada ..... 9/8 R
3,903,705 9/1975 Beck ..... 114/293

FOREIGN PATENT DOCUMENTS 942590 2/1974 Canada ..... 114/293

*Primary Examiner*—Trygve M. Blix
*Assistant Examiner*—D. W. Keen
*Attorney, Agent, or Firm*—Guy E. Matthews

[57] ABSTRACT

Disclosed is a single point mooring system for mooring vessels at a certain distance from offshore structures. The system includes a buoy positioned in the water and a cable attached at one end of the buoy and attached at the other end to a reel or the like for reeling in or reeling out cable to move the vessel back and forth relative to the buoy. Another cable is attached to the buoy and depends downwardly therefrom into the water where it is attached to a sinker ball resting on the bottom. An anchor is connected to the sinker ball.

1 Claim, 5 Drawing Figures

SINGLE POINT MOORING SYSTEM

BACKGROUND OF THE INVENTION

1. Field of the Invention

This invention relates to a mooring system for boats and the like that is safe and easy to use and prevents boats, vessels, and the like from damaging or becoming damaged by offshore structures.

2. Description of the Prior Art

There are several different mooring systems in use for attempting to moor vessels relative to stationary objects such as drilling rig platforms or production platforms offshore. Such mooring systems usually are difficult to operate because of difficulty in placing the anchor in the underwater sea, bay, or riverbed and in attempting to maintain a standard or steady distance between the vessel and the offshore structure. Obviously, when the vessel and offshore structure collide, there could be damage to the vessel or offshore structure, or both, each of which is extremely expensive to repair.

BRIEF SUMMARY OF THE INVENTION

In accordance with the present invention, a new and improved single point mooring system provides a ball, buoy, or mooring buoy with a retractable line relative to the vessel which is mounted with a plurality of weighted balls or objects which is in turn mounted with a sufficient anchor to insure that the anchor becomes buried in the seabed.

BRIEF DESCRIPTION OF THE DRAWINGS

Novel features believed characteristic of the invention are set forth in the appended claims. The invention and its preferred embodiments however will best be understood by a reading of the specification set forth hereinbelow in conjunction with the drawings wherein:

DESCRIPTION OF THE PREFERRED EMBODIMENT

Figure 1:
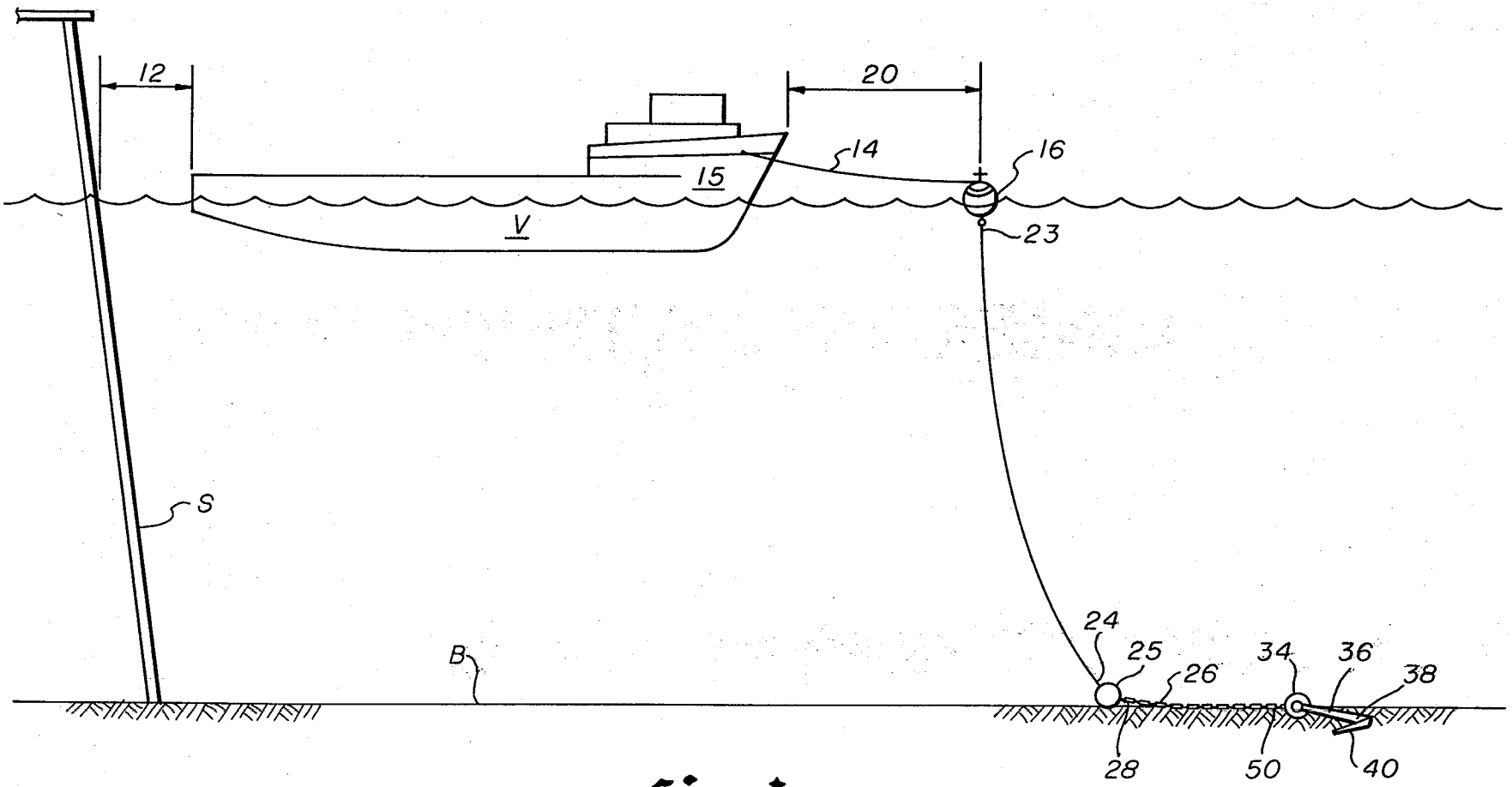
FIG. 1 is an overall schematic view illustrating the relationship of the single point mooring system of the present invention relative to a vessel and offshore structure.

As illustrated from FIG. 1 of the present invention, a vessel V is shown floating in the water W along the wave action area WA wherein an offshore structure such as a flow line riser, production platform, or drilling rig illustrated at S (only partially shown) is positioned on the ocean floor or seabed B. As further illustrated, the vessel V and structure S are separated by a distance 12 which will be explained more fully hereinafter. A suitable cable 14 extends from a winch or the like (not shown) from the bow 15 of the vessel V and is attached to a ball or mooring buoy 16 which floats in the wave action area WA. As illustrated in FIG. 1, the vessel V and buoy 16 are separated by a distance 20 as will be set forth more fully hereinafter. Yet another cable 22 is attached at one end 23 to the buoy 16, and at its opposite end 24 to a weighted sinker ball or weighted object 25 and normally rests on the seabed B. As further illustrated, a chain 26 is connected at one end 28 through the sinker ball 25 to cable end 24, and the other end 30 of cable 22 extends through yet another sinker ball 34 for attachment to an end 36 of anchor 38. As further illustrated in FIG. 1, the sinker ball 34 is partially embedded in the seabed B due to the fact that the anchor blades 40 of anchor 38 have become embedded in the seabed B.

Figure 2:
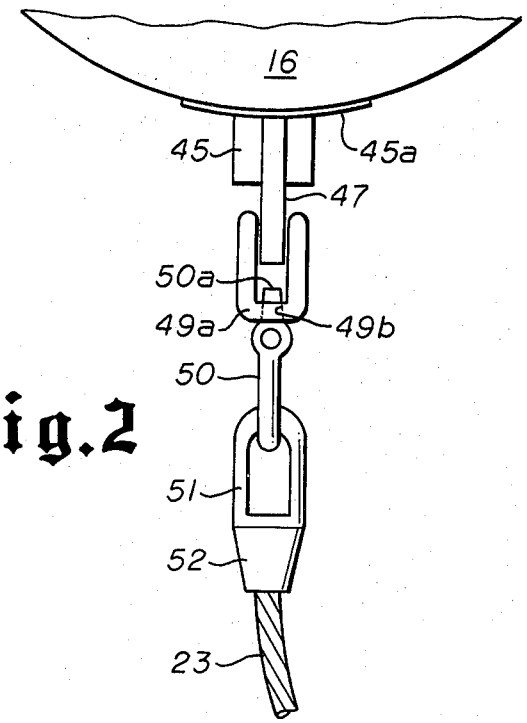
FIG. 2 is an enlarged view illustrating a cable connection with a ball buoy.

As illustrated in FIG. 2, the buoy 16 (only part of which is shown) is secured with the end of cable 23 by an end connection member 45 having a base plate **45*a* rigidly secured and connected with the buoy 16. Member 45 and base plate 45*a* have a swivel member 47 secured therewith which extends outwardly for connection with a buoy swivel 49 secured with such swivel member 47 through suitable nut and bolt or pin means (not shown). A safety shackle 50 extends through one end 49*a* of the buoy swivel 49 through opening 49*b* such that one end 50*a* of the shackle 50 is mounted adjacent the end 49*a* as illustrated in FIG. 2. In this manner, the shackle 50 is allowed to freely rotate relative to the buoy swivel 49. Safety shackle 50 includes an eye or opening (not shown) for receiving closed eye socket 51 which, as illustrated, is fixedly secured at its end 52 to cable 22**.

Figure 4:
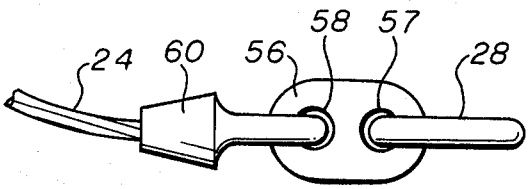
FIG. 4 illustrates a connection between a cable of the present invention and a chain utilized with the present invention.

As illustrated in FIG. 4, the end 24 of cable end 23 is mounted with the end 28 of cable chain 26 through the sinker ball member 25 (not shown in FIG. 4) by a connection link 56 having eye openings 57 and 58 which receive closed eye socket 60 similar in shape to closed eye socket 51. As illustrated, closed eye socket 60 fixedly secures the end 24 of cable end 23. Eyelet or eye opening 57 secures the link or end 28 through the eyelet 57 in a manner well known in the art.

Figure 5:
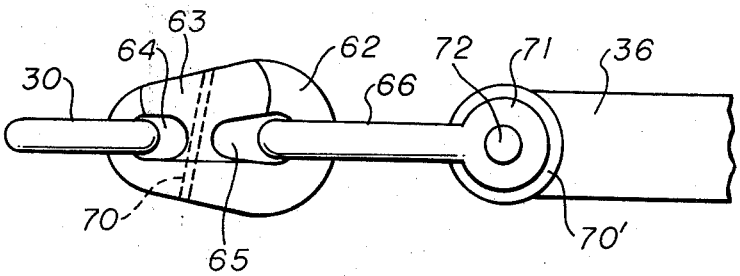
FIG. 5 is an enlarged view illustrating the attachment of a chain relative to an anchor of the present invention.

As illustrated in FIG. 5, the end 30 of chain end 28 is mounted with pear-shaped link 62 which includes a removable section 63 communicating with each of the openings 64 and 65 in the link 62 such that the section 63 can be removed to receive the end 30 of the chain link in such opening and a hook section 66 mounted with the end 36 of anchor 38. After the end 30 of chain end 28 and hook section 66 are positioned in the openings 64 and 65, respectively, the removable section 63 of pear-shaped link 62 is inserted back in place to fill the gap created by such removal and to close the pear-shaped link such that openings 64 and 65 are prevented from communicating with the exterior surface of the pear-shaped link. Thereafter, a suitable pin or bolt connection 70 extends through the member 63 and into a portion of the body of the pear-shaped link 62 for securing the portion 63 to the remainder of the pear-shaped link 62. The end 36 of anchor 38 includes a pad eye 70' for receiving the safety shackle end 71 integrally mounted with the hook section 66. A suitable bolt or pin means 72 secures the pad eye 70' with safety shackle 71 as is known in the art.

Figure 3:
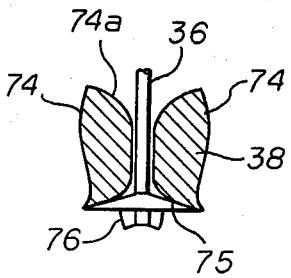
FIG. 3 is an enlarged view of an anchor of the present invention.

As illustrated in FIG. 3, anchor 38 includes the connection end 36 which is mounted with the end 30 of cable chain 26 and a pair of swivel blades 74 extending on each side of the connection portion or end 36, and it is to be understood that the blades 74 are constructed in such a manner so as to have a front section or portion **74*a* which extends immediately adjacent the connection section 36 and as is illustrated in FIG. 3. As is well known in the art, connection section 36 extends through the end 75 of the anchor 38 for connection with a suitable pivotal nut or other means 76 such that the blades are permitted to pivot about the connection rod or section 36. With the leading blade or edge section 74***a* of each of the blades 74 having a large surface area relative to the blades 74, the front section 74*a* readily digs in and becomes embedded in the seabed B and because of the leading edge or front section 74*a* having a large surface area relative to the blades 74, anchor 38 can withstand a large amount of pulling force before being pulled from the seabed B.

In operation, the vessel V is positioned in the vicinity of the structure S, and anchor 38 dropped overboard. Anchor 38 is mounted with chain 26 which in turn is mounted with the cable 22 as set forth hereinabove and due to the sinker balls or members 25 and 34 which are heavily weighted, the anchor sinks immediately to the seabed B. Since the sinker balls 25 and 34 slow down any movement of the vessel V due to wave action or tide, the anchor 38 quickly becomes embedded in the seabed B due to the action of the leading edge 74*a* of the blades 74 as set forth hereinabove.

The ball or mooring buoy 16 is also positioned in the water W and floats in the wave action area WA and is connected to cable 22. Cable 14 is also connected to the buoy or ball 16 and to a suitable reel on the bow 15 of vessel V such that the cable 14 can be reeled in which would move the vessel V closer to buoy 16 or which can be given slack which would enable the boat or vessel V to drift further away from buoy 16 to thus vary the distances 20 and 12 between the vessel V and the buoy 16 and the vessel V and the structure S, respectively.

While certain embodiments of the present invention have been presented herewith, it is to be understood that the following appended claims are not limited to such preferred embodiments and are only limited by the constraints of the prior art.

What is claimed is:

1. A single point mooring system for securely mooring vessels at a desired distance from a stationary object, comprising:

(a) a first cable having a first end and second end, the first end being connected to a powered winch aboard the vessel;

(b) a buoy affixed to the second end of the first cable;

(c) a second cable having a first end and second end, the first end being universally pivotally connected to the buoy;

(d) a first sinker ball means pivotally connected to the second end of the second cable means, said first sinker ball means positioned on the ocean floor;

(e) a chain having a first and second ends, said first end being pivotally connected to the second end of the second cable and first sinker ball means;

(f) a second sinker ball means, pivotally connected to the second end of the chain;

(g) an anchor, having a shaft pivotally and axially rotatably connected to the second end of the chain, said anchor further having a plurality of blades obliquely oriented with respect to the shafts so as to readily engage the ocean floor when dragged thereupon towards the vessel.

* * * * *